United States Patent [19]

Schmid et al.

[11] 4,103,517

[45] Aug. 1, 1978

[54] STRAIGHT KNITTING MACHINE

[76] Inventors: Manfred Schmid, Morikestr. 8, 7445 Bempflingen; Werner Sommer, Kolpingstr. 51, 7300 Esslingen; Antonius Vinnemann, Am Bopserweg 11, 7000 Stuttgart 1, all of Fed. Rep. of Germany

[21] Appl. No.: 776,909

[22] Filed: Mar. 11, 1977

Related U.S. Application Data

[63] Continuation of Ser. No. 705,286, Jul. 14, 1976, abandoned.

[30] Foreign Application Priority Data

Jul. 16, 1975 [DE] Fed. Rep. of Germany ..... 2531705

[51] Int. Cl.[2] ..... D04B 7/00; D04B 15/66

[52] U.S. Cl. ..... 66/75.1; 66/78; 66/64

[58] Field of Search ..... 66/60, 64, 78, 77, 62, 66/63, 65, 66, 71, 72, 75.1, 73

[56] References Cited

U.S. PATENT DOCUMENTS

| | | | |
|---|---|---|---|
| 528,810 | 11/1864 | Salisbury | 66/64 |
| 559,850 | 5/1896 | Johanson | 66/44 |
| 616,600 | 12/1898 | Burson | 66/71 |
| 3,910,071 | 10/1975 | Schieber et al. | 66/64 |

FOREIGN PATENT DOCUMENTS

| | | | |
|---|---|---|---|
| 44,888 | 1966 | German Democratic Rep. | 66/64 |
| 1,296,733 | 6/1969 | Fed. Rep. of Germany | 66/72 |
| 493,837 | 5/1954 | Italy | 66/64 |
| 996,125 | 6/1965 | United Kingdom | 66/60 |
| 5,702 of | 1893 | United Kingdom | 66/62 |

*Primary Examiner*—Ronald Feldbaum

[57] ABSTRACT

A knitting machine having reciprocable knitting tools and a cam operated means for reciprocating said knitting tools in which said cam operated means provides an amount of play in the movement of the knitting tools and means for moving said knitting tools an additional distance within the play permitted by said cam operated means.

25 Claims, 8 Drawing Figures

STRAIGHT KNITTING MACHINE

This is a continuation, of application Ser. No. 705,286, Filed Jul. 14, 1976, now abandoned.

The invention relates to a knitting machine having at least one knitting tool, an eccentric cam disc adapted to be coupled in driving relationship with the knitting tool for moving it in at least two opposite directions, and an arrangement for adjusting the extent of the distance of movement in one of these two directions.

In known knitting machines of this kind (German Laidopen Pending Patent Application 1 585 454), which may also be described as carriageless or lockless knitting machines, the knitting tools are each coupled via a slotted butt to a driver pin mounted on the cam discs. This results in the disadvantage that a variable adjustment of the sinking depth or loop size is not possible. A possibility of adjustment which is effective in the same way for all the knitting tools is provided by the fact that the driving shaft bearing the cam discs is mounted in a guide block which can be shifted in the direction of the movement of the knitting tools. Of course, an adjustment of the driving shaft can be carried out only when the knitting machine is at rest.

It is true that in a similar known knitting machine (German Laid-open Patent Specification 1 296 733, German Laid-open Pending Patent Application 1 635 968) a variable adjustment of the loop size is conceivable, but in this case there is the disadvantage that the knitting tools cannot be coupled with the cam disc for driving in both direction. On the contrary, each knitting tool must be driven with the aid of a control lever having two arms, one of which is subject to the effect of the cam disc, while the other is coupled with the knitting tool. The two arms are pivotally mounted on a common axis and are so held by a tension spring in a certain relative position that on a movement of the knitting tool in the camming-down or lowering direction the movements of the arm subject to the effect of the cam disc are transmitted via the tension spring to the arm coupled with the knitting tool. For adjusting the distance of movement in the camming-down direction, i.e. for adjusting the sinking depth, adjustable stops are provided which block the movements of the arm coupled with the knitting tool in opposition to the force of the tension spring. The forces for camming the knitting tools down are therefore not applied by the cam discs, but by the tension springs, which results in the further disadvantage that the drive of the cam discs must operate at least in part against these spring forces.

The object of the invention is to obviate the disadvantages of the described state of the art by providing a new arrangement for adjusting the extent of the distance of movement of the knitting tools in at least one direction.

The special problem underlying the invention is to design the said arrangement in a knitting machine of the kind described at the beginning so that the distance of movement of the knitting tools in at least one direction can be adjusted variably even when the drive of the knitting tools in both directions is effected with the avoidance of spring forces by driving connection or coupling of the knitting tool with the cam disc or in some other manner.

The invention is characterised in that the driving connection of the knitting tool with the cam disc has so much play that, in addition to the movement produced by the cam disc, the knitting tool is movable by a length which is small in comparison with the distance of movement produced by the cam disc, and that the arrangement for adjusting the extent of the distance of movement comprises means for additional movement of the knitting tool in one direction by a preselectable part of this length. The said means advantageously comprise an adjustable cam device movable transversely of the directions of movement of the knitting tool and co-operating with a butt of the knitting tool.

A preferred constructional form of the invention starts from a knitting machine having at least one needle bed in which there is a mounted plurality of parallel-arranged knitting tools having butts, with each of which knitting tools a cam disc is associated, the cam discs being arranged on a rotatable driving shaft with an angular staggering, and is characterised in that the cam device is arranged on a driving device movable from beginning to end of the needle bed and has a cam rising in one direction and acting on the butts, the cam beginning at a height which corresponds to the position of the butts of the knitting tools shortly before the termination of a movement produced by a cam disc in one direction, and that the speed of the conveying device and the speed of the driving shaft are so synchronised that the movement of the cam device is adapted to the phase relationships of the individual knitting tools which depend on the angular staggering of the cam discs.

The invention brings with it the advantage that, for example, the camming-down or lowering movement of the knitting tools is split up into two cumulative sections, the cam discs, in one movement section, effecting a constant camming-down of the knitting tools for example into the normal run-through position and in the other movement section the cam device effects an adjustable downward movement of the knitting tools from the normal run-through position to the required sinker depth. The two movement sections preferably follow one another, although owing to the play in the driving connection between the knitting tools and the cam discs they could also take place simultaneously or with partial overlap.

Further advantageous features of the invention are characterised in the sub-claims.

The invention will be described in more detail below, with reference to the accompanying drawings of practical examples, in which.

Figure 1:
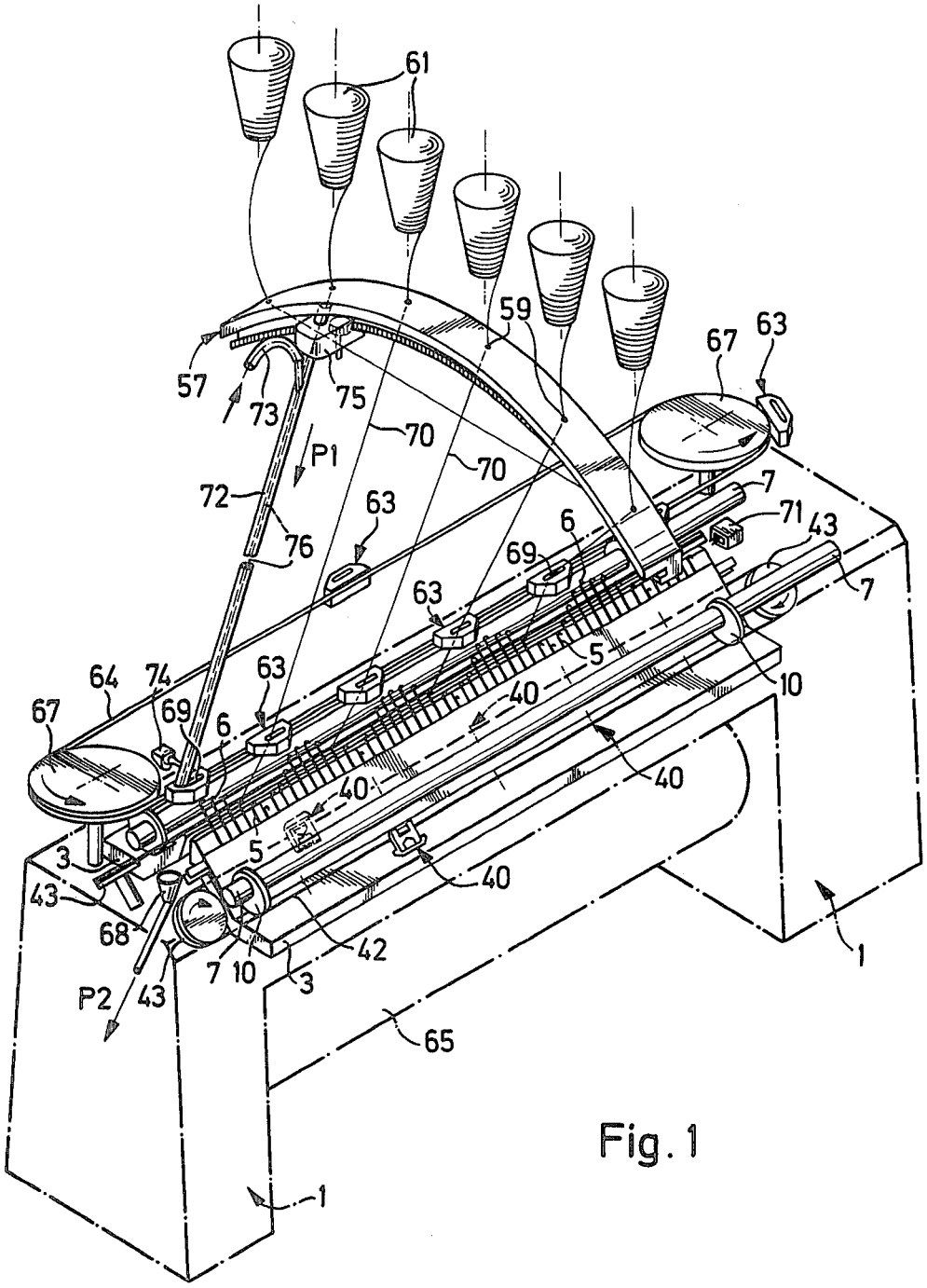
FIG. 1 shows diagrammatically a perspective overall view of a knitting machine according to the invention.
Figure 2:
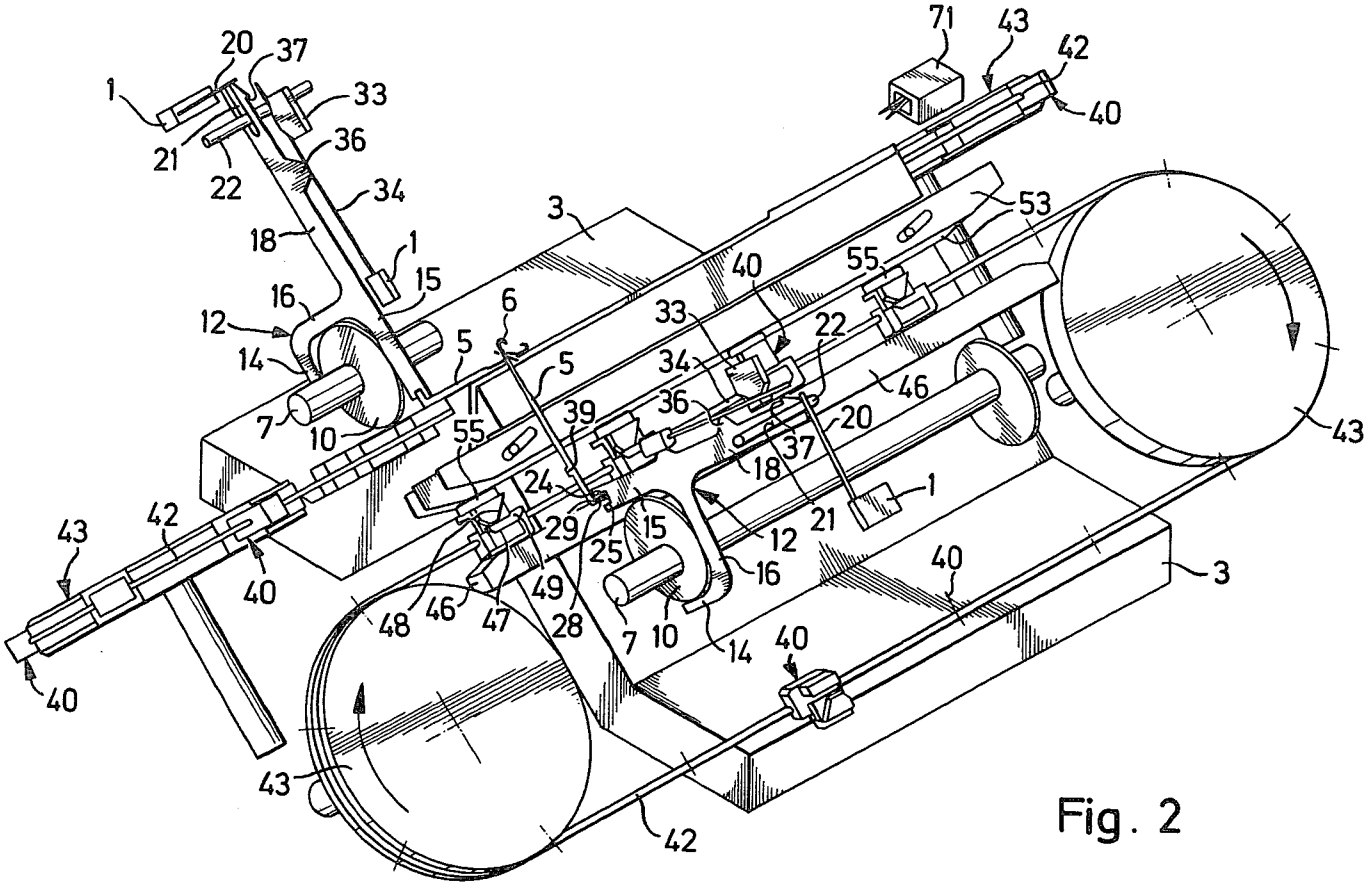
FIG. 2 shows an enlarged part view of the knitting machine of FIG. 1.
Figure 3:
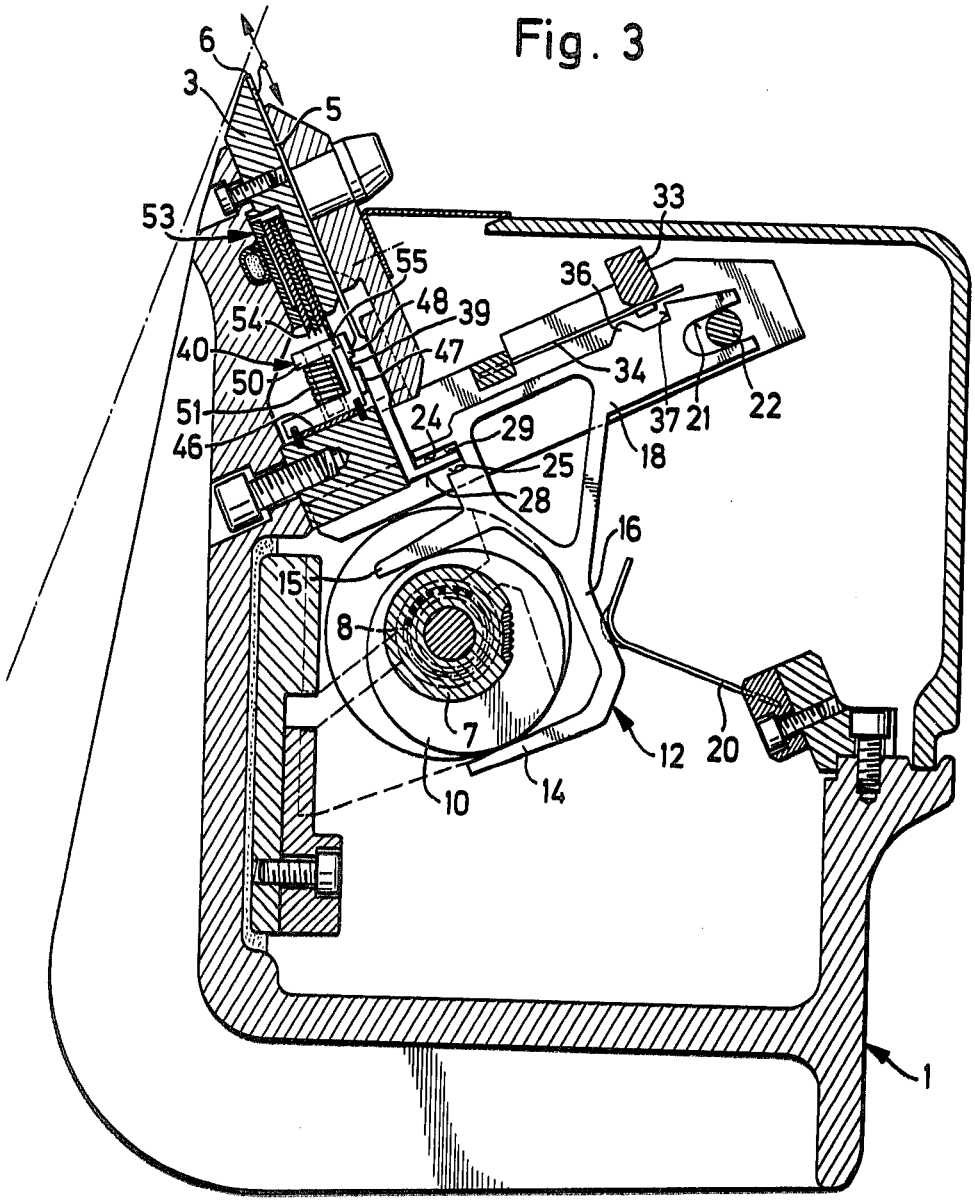
FIG. 3 shows a section through a needle bed of the knitting machine of FIG. 1.

The knitting machine according to the invention is illustrated in FIGS. 1 to 3 by the example of a flat knitting machine. Mounted fixedly in V form in a frame 1 are two needle beds 3 in the grooves of which knitting needles 5 with hooks 6, preferably latch needles, are mounted to be longitudinally slidable in known manner. In each needle bed 3, a driving shaft 7 is rotatably mounted in bearings 8. The driving shafts 7 can be rotated at the desired speed by means of drives (not shown). A number of eccentric cam discs 10 corresponding to the number of knitting needles 5 is arranged on the driving shafts 7, the cam discs being rotationally fast with these shafts, each cam disc 10 being arranged in the same plane as the associated knitting needle 5 and having a thickness which is smaller than the distance of the associated knitting needle 5 from the two adjacent needles. Alternatively, the cam discs 10 may be located in a different plane to that of the associated knitting needles 5, in which case the driving elements 12 may have a suitable bend or crank.

In accordance with FIGS. 2 and 3, on each cam disc 10 there is mounted a driving element 12 which is advantageously located in the same plane as the associated cam disc 10. Each driving element 12 is preferably in the form of a fork having two substantially parallel arms 14 and 15 which are connected by a connecting web 16 arranged substantially at right angles to them and operative as a coupling element. The two arms 14 and 15 embrace the cam disc 10 in the chosen example from two sides in such manner that their points of contact with the cam disc 10 are located on a line extending substantially parallel to the axes of the needles, so that on rotation of the driving shafts 7 the driving elements 12 are raised and lowered parallel to the axes of the needles by the cam discs 10 and in this way perform clearing and camming-down strokes. The cam discs 10 and the driving elements 12 are preferably so designed that, irrespective of the angular position, the two arms 14 and 15 always bear against at least two opposite points on the cam disc 10, so that the driving element 12 is guided positively in each stage of its movement by the cam disc 10. For this purpose, the cam disc 10 does not need to be of circular form, but it is sufficient for it to constitute a lobed cylinder of which all the diameters are of equal length.

Provided on a lateral part of the driving element 12 facing the connecting web 16 is a shank 18 on the end of which, as shown in FIG. 2, there acts a pressure-applying spring 20 fixed to the machine frame 1, which tries to apply the connecting web 16 against the cam disc 10 and, according to FIG. 3, may bear alternatively against a different part of the driving element 12. The shank 18 is mounted in a sliding and pivot bearing which, for example, is formed by a slot 21 in the shank 18 and a pivot pin 22 fixed in the frame 1 and extending through the slot 21, so that on the one hand, by reason of the action of the pressure-applying spring 20, the driving element 12 is held against the cam disc 10 and, on the other hand, by reason of the sliding and pivot bearing 21, 22, is slidably and pivotally mounted. Alternatively, the driving element 12 may advantageously be mounted in a spring 23 (FIG. 27), so that it is able to carry out similar movements to those when it is mounted in the sliding and pivot bearing 21, 22. The spring 23 may at the same time take over the function of the pressure-applying spring 20.

In an upper section of the driving element 12 there is provided a recess the upper edge of which serves as a camming-down portion 24 and the lower edge of which serves as a clearing or driving-out portion 25 for the butt of the knitting needle 5 associated with the recess, the lower edge of which butt is accordingly to be regarded as the clearing means 28, while its upper edge is to be regarded as the camming-down means 29. The camming-down portion 24 has a length such that it overlaps the camming-down means 29 during the camming-down throw of the cam disc 10 in every possible position of the driving element 12, whereas the clearing portion 25 is so short that it overlaps the clearing means 28 only in the coupling position of the coupling element 16 which can be seen in FIGS. 2 and 3 and, on the other hand, is located outside the effective range of the clearing means 28 in an uncoupling position.

For control of the knitting needles 5 according to pattern, a control device is provided for each of the needles and comprises, in the embodiment illustrated, a holding magnet 33 controllable according to pattern and a control spring 34, both of which are fixed in the frame 1. The control spring 34 is clamped at one end and its free end can be applied under initial tension against the polar surface of the holding magnet 33 by means of a projection 36 provided on the shank 18. If the holding magnet 33 attracts the control spring 34, then the connecting web 16 can be applied against the associated cam disc 10 by the pressure-applying spring 20 until the clearing portion 25 overlaps the clearing means 28. On the other hand, if the control spring 34 is not attracted by the holding magnet 33, then it drops from its polar surface by reason of its initial tension and applies itself against an abutment 37 formed on the shank 18, so that in spite of the action of the pressure-applying spring 20 the driving element is arrested in a retracted position and the clearing portion 25 remains outside the range of engagement of the clearing means 28.

The cam discs 10 arranged on the driving shafts 7 preferably have a constant angular staggering, so that in known manner a shape or course after the fashion of a thread is obtained and those cam discs which are arranged within a pitch form a knitting system. To produce the desired angular staggering, the cam discs 10 may be provided with a suitable inner serration, while the driving shafts 7 are provided with a corresponding outer serration. Alternatively, a spacing disc provided with an inner serration may be arranged between the cam discs in each case, while the cam discs 10 themselves do not have any inner serration, but are mounted almost free from play on the driving shafts 7. so that in the centred state they can be rotated into any position and then be fixed to the spacing discs or the like by cementing. For example, every 24, 36 or 72 adjacent knitting needles 5 form a knitting system, i.e. every 24, 36 or 72 cam disc 10 is mounted on the driving shafts 7 in the same angular position. In the embodiment which can be seen in FIG. 1, every ten adjacent knitting needles 5 form a knitting system and a total of five knitting systems is provided on each needle bed 3. The phase relationship of the two driving shafts 7 may be varied for reasons of knitting technique. In the embodiment shown in FIGS. 1 and 2, each knitting needle 5 has a knitting butt 39 which can co-operate with a plurality of cam devices 40. The cam devices 40 are fixed to endless belts 42 which are mounted in each case on at least two guide pulleys 43 or other guide elements and are driven by means of a driving device (not shown). The direction of conveyance is indicated by arrows on the guide pulleys 43. In the region of the two rows of needles, the cam devices 40 run parallel to the needle beds 3 onto stationary slide rails 46 extending over the entire width of the needle beds, so that they may always be arranged at the same unvarying height while they are travelling past the knitting needles 5. Each cam device 40 has a first cam 48 operative in the camming-down direction and a second cam 47 rising in the clearing direction, which together form a track 49 into which the knitting butts 39 of the knitting needles 5 run in order first to be cammed or drawn down by the first cam 48 for the purpose of forming a loop and then to be brought back into the normal run-through position by the second cam 47.

As can be seen in particular from FIG. 3, the second cam 47 is secured to a fixed part of the cam device 40, whereas the first cam 48 is mounted slidably on the cam device 40 and has an arm 50 on which a compression spring 51 mounted on the cam device 40 acts. At least one slide rail 53 extending over the entire width of the needle beds 3 and adjustable in height serves as a counter-bearing for the upper edge of the cam 48. Preferably, a plurality of such adjustable slide rails 53 are provided, these having a guide 54 on their side facing the upper edge of the cam 48. In a number of grooves corresponding to the number of these guides 54, which are formed in the upper edge of the arm 50, plates 55 selected according to pattern can be inserted individually, the upper edges of these plates entering the guide 54 associated with them and thereby fixing the distance between the two cams 47 and 48. In this way, the sinking depth of the knitting needles 5 can be adjusted differently by the cams 48.

The cam devices 40 are arranged at such a height relative to the knitting butts 39 that the latter can enter the track 49 only after the knitting needles 5 have been cammed down almost as far as the normal run-through position by means of the camming-down portions 24 of the driving elements 12. The cams 48 therefore become operative only at the end of a complete camming-down throw of the cam discs 10 and produce only that small part of the camming down which serves to form a loop or draw the loop of yarn formed by a hook 6 through the previously formed loop disposed on the needle shank, whereas the major part of the camming down is carried out with the aid of the driving element 12 driven positively by the cam disc 10. In order to avoid the additional camming-down stroke produced by the cam 48 disturbing the camming-down stroke produced by the driving element 12, the arrangement is such that the distance between the camming-down portions 24 and the clearing portions 25 of the driving elements 12 is about as much greater than the distance between the clearing means 28 and the camming-down means 29 of the knitting needle 5 as corresponds to that additional camming-down stroke which can be achieved at the most with the camming-down or lowering cam 48, i.e. the driving connection of the knitting needle 5 with the cam disc 10 has so much play that the knitting needle 5 is movable in the direction of its movement by a sufficiently large distance in addition to the movement produced by the cam disc 10.

The distance between neighbouring cam devices 40 on the belts 42 corresponds to the distance between the knitting systems expressed by the number of needles. The conveying speed of the belts 42 is so synchronized with the rotation of the driving shafts 7 that the first cams 48 always begin to act on a knitting butt 39 when the associated knitting needle 5 has been cammed down or lowered almost as far as the run-through position by the associated driving element 12.

The arrangement shown in FIG. 1 may, for example, be employed for supplying the yarn. Above the machine frame there is arranged a carrier 57 for yarn eyelets 59 which is disposed substantially in the middle of the needle beds 3 and at right angles to them and is so curved that all the yarn eyelets 59 are at substantially the same distance from the gap extending between the two needle beds 3. Above the yarn eyelets 59 there are provided in a creel (not shown) as many yarn bobbins 61 as there are yarn eyelets 59, it also being possible for reserve bobbins to be provided in known manner in case of need.

In the region of the hooks 6 of the knitting needles 5, referred to their clearing position, a plurality of yarn guides 63 are provided. The yarn guides are fixed to endless belts 64 which are mounted in each case on at least two guide pulleys 67 or other guide elements and are carried past the knitting needles along a line parallel to the needle beds 3 by means of a driving device (not shown). Each yarn guide 63 has an eye 69 into which a thread 70 coming from some yarn bobbin 61 can be placed. During movement of the yarn guides 63 in the direction of the arrows on the guide pulleys 67, a cutting device 71 known per se for the threads 70 is located at the ends of the needle beds 3 which are on the right in FIG. 1. This cutting device has the function of cutting off the thread 70 offered by any yarn guide 63 as soon as it has been seized by the hook 6 of the last knitting needle 5 which works up this thread.

In order to carry the yarn end which becomes free through the cutting operation back to the end of the needle beds 3 which is on the left in FIG. 1, there is provided a blowing tube 72 through which compressed air is forced in the direction of the arrow P1 by means of a flexible tube 73 connected to a source of compressed air. The lower end of the blowing tube 72 is arranged in close proximity above that point at which the eyes 69 provided in the yarn guides 63 travel past and, for example, is mounted in a ball-and-socket joint 74 or the like. Associated with the blowing tube 72 is a swinging mechanism 75 which is basically of any kind and by means of which the upper end of the blowing tube 72 can be arranged close below each yarn eyelet 59. Each blowing tube 72 moreover has a lateral slot 76 extending through from top to bottom and directed towards the right-hand end of the needle beds 3 in FIG. 1 and which, in case of need, may be covered with an elastic material fixed along one edge of the slot, this elastic material, on the one hand, ensuring satisfactory conveyance of the thread in the blowing tube, yet on the other hand rendering possible lateral withdrawal of a thread in the blowing tube through the slot. Finally, the upper end of the blowing tube is so designed that, in conjunction with the compressed air supplied, it exerts a combined sucking and blowing action. The result of this is that a length of yarn hanging down through a yarn eyelet 59 and free at the end and therefore uncontrolled is, on the one hand, drawn to the upper end of the blowing tube 72 and, on the other hand, conveyed from there through the blowing tube 72 to its lower end, after adjustment of the upper end of the blowing tube 72 to the said yarn eyelet 59.

In order to clamp the free yarn end conveyed from the end of the needle beds 3 to the beginning of the needle beds 3 by means of the blowing tube 72, it is possible to provide at the left-hand end of the needle beds 3 in FIG. 1 either a conventional yarn clamping device (not shown) or a pneumatic suction device 68, by means of which the yarn end is retained with the aid of suction or intake air at least until the thread 70 has been inserted in a number of hooks 6 and has been worked up by them into a loop.

The yarn guides 63 are arranged on the belts 64 at intervals which correspond to the width of the knitting systems expressed by the number of needles. The conveying speed of the belts 64 is so synchronized with the speed of the driving shafts 7 that a thread 70 is offered to the open hooks 6 of the cleared knitting needles 5 shortly before these knitting needles 5 selected for knitting are cammed down by means of the driving elements 12 and then by means of the cam devices 40.

If a three-colour pattern is to be produced on the five-system or five-feed knitting machine shown in FIG. 1, then six yarn bobbins 61, for example, are used for this purpose, each two yarn bobbins 61 being furnished with yarn of the same colour. The following operations therefore occur in constant repetition and may partly overlap. On the one hand, the thread carried past the hooks 6 of the selected knitting needles by any yarn guide 63 is cut off at the right-hand end of the needle beds 3, i.e. at the end of the knitted fabric, so that the thread hangs down freely from the associated yarn eyelet 59 and the associated yarn guide 63 can travel back at a rear part of a needle bed 3 to the left-hand part of the needle beds, i.e. to the beginning of the knitted fabric. On the other hand, after a thread conveyed in the blowing tube 72 to the beginning of the knitted fabric has been withdrawn through the lateral slot, the upper end of the blowing tube is adjusted to the eyelet 59 of that thread whose end is to be carried back, whereby this thread is sucked up in the direction of the eyelet 59, conveyed through the blowing tube 72 to the beginning of the knitted fabric, threaded into the eye 69 of the next yarn guide 63 travelling past below the lower end of the blowing tube 72 and finally retained at the beginning of the knitted fabric before this next yarn guide 63 comes into the insertion position for the first knitting needles 5. Since there are five systems or feeds, whereas there are six threads, a thread is always free in this way for being carried back.

A thread 70 which has been inserted in the eye 69 of a yarn guide 63 with the aid of the blowing tube 72 travels in the direction of the end of the knitted fabric together with this yarn guide. Since the thread end is first retained at the beginning of the knitted fabric, the thread is withdrawn through the slot of the blowing tube 72 by reason of the movement of the yarn guide, this withdrawal commencing in the lower part of the blowing tube 72 until, after the yarn guide has moved past a certain number of knitting needles 5, the entire length of thread between the yarn guide 63 and the yarn eyelet 59 has been drawn out of the blowing tube 72, so that its upper end can be adjusted to the eyelet 59 of the thread to be conveyed subsequently in good time before the arrival of the next yarn guide 63.

In dependence upon the number of knitting systems and the number of colours required, a plurality of blowing tubes may also be employed and their working cycles then partly overlap. Finally, by control of the blowing tube, it is possible to vary the sequence of the threads to be worked up in any desired manner. For winding down and batching or taking up the knitted fabric produced during the operation of the knitting machine, a winding-down and batching arrangement 75 is provided, this being accommodated below the gap in the frame 1 between the two needle beds 3.

The knitting machine described operates in the following manner:

To knit a single-colour knitted fabric without any pattern, the control springs 34 are constantly attracted by the holding magnets 33, so that they remain constantly swung out of the range of the abutment 37 of the shank 18. In consequence, if the movement of any knitting needle 5 is considered, the associated cam disc 10 first moves the driving element 12 mounted on it upwardly, the clearing portion 25 of the driving element 12 engaging below the clearing means 28 of the knitting needle 5 by reason of the action of the pressure-applying spring 20 and raising the knitting needle until the clearing throw of the cam disc 10 has been completed and the knitting needle 5 has reached its highest position. At this moment, a yarn guide 63 travels past the opened hook 6 of this knitting needle 5, so that a thread 70 is inserted and is drawn into a loop by the hook 6 during the following camming-down throw of the cam disc 10. During the first half of this camming-down throw, the cam disc 10 presses simultaneously against the connecting web 16 which is operative as a coupling element, so that this connecting web is also shifted, together with the entire driving element 12, in a direction at right angles to the axis of the knitting needle 5 in opposition to the force of the pressure-applying spring 20. During this movement, the camming-down portion 24 remains constantly in engagement with the camming-down means 29 of the knitting needle 5. Since the control spring 34 is retained by the holding magnet 33, the driving element 12 is shifted back again during the second half of the camming-down throw of the cam disc 10 in the direction at right angles to the axis of the knitting needle 5 by reason of the action of the pressure-applying spring 20, so that the clearing portion 25 of the driving element 12 is again coupled with the clearing means 28 of the knitting needle at the beginning of the next clearing throw of the cam disc 10.

After completion of the camming-down throw, a cam device 40 has reached such a position that its cam 48 begins to act on the knitting butt 39 of the knitting needle 5 located in the run-through position and imparts to the knitting needle 5 a sinking stroke the size of which has been adjusted beforehand to the desired value by means of the slide rails 53, while at the same time the cam disc 10 begins its clearing throw, so that the knitting needle 5 is brought into its highest position again after completion of the sinking stroke. When the knitting needle 5 has reached this highest position again, the next yarn guide 63 is then in range of its hook 6, so that a thread can again be inserted.

If a pattern is to be produced by the knitting needle 5 considered remaining in the run-through position during a clearing throw of the cam disc 10, then a control signal is so supplied to the holding magnet 33 that the control spring 34 drops off by reason of its initial tension and applies itself against the abutment 37 when the driving element 12 moves back in the direction at right angles to the axis of the needle. The connecting web 16 and also the driving element 12 are thereby arrested in a position in which the clearing portion 25 is outside the effective range of the clearing means 28 and consequently the knitting needle 5 is not raised during the clearing throw of the cam disc 10. Since, however, the driving element 12 is raised with each clearing throw, the projection 36 is applied against the control spring 34 and presses its end against the polar surface of the holding magnet 33 again, so that a fresh selection can be carried out.

Finally, if a multi-coloured pattern is to be produced, then on the one hand threads 70 of different colours are supplied to the yarn guides 63, while on the other hand the holding magnets 33 associated with the knitting needles 5 are suitably triggered, so that a Jacquard knitted fabric is produced in the usual manner. In this case, however, a course is not formed as each individual yarn guide 63 passes by the needle beds 3, but a number of yarn guides correspond- to the number of colours must be carried past the needle beds to form a course.

The production of stripe patterns is possible without triggering the holding magnets 33 in that only threads of a certain colour are blown into the eyes 69 of the yarn guides 63 by means of the blowing tube 72 over a certain number of courses and then a change is made according to pattern to the threads of a different colour.

Figure 4:
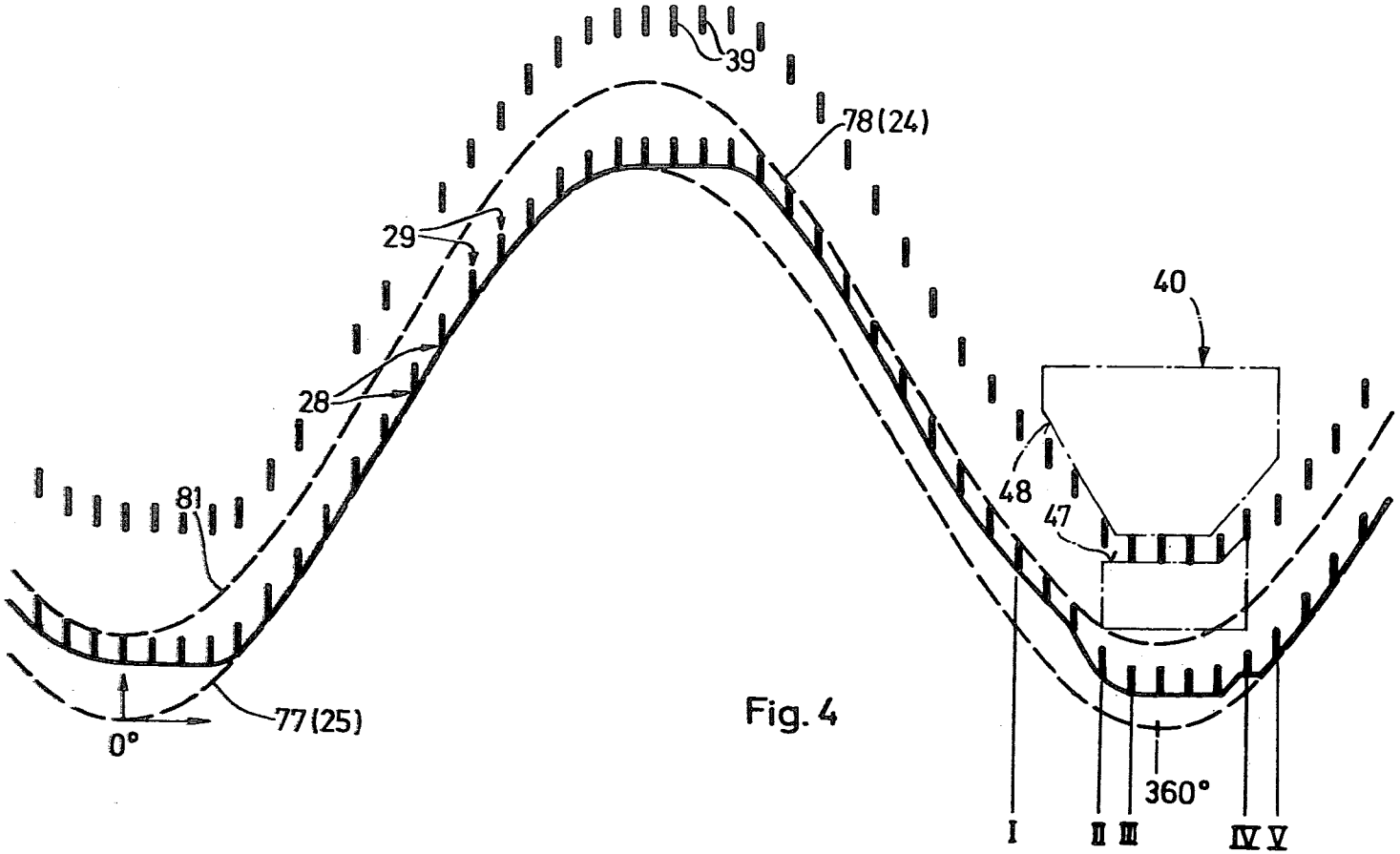
FIG. 4 shows diagrammatically the individual phases of movement of the knitting machine during a complete rotation of a cam disc.
Figure 5:
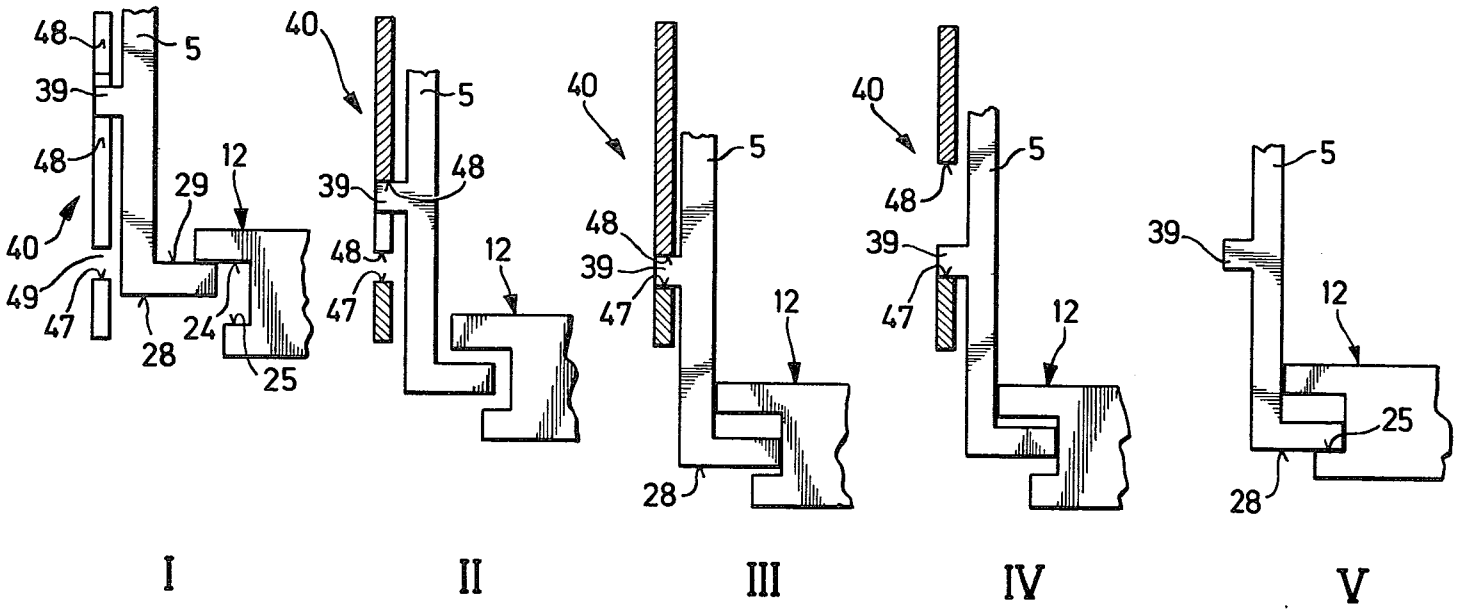
FIG. 5 shows diagrammatically sections through a needle bed at the positions I to V shown in FIG. 4.

The individual stages of movement of the knitting needles 5 can be understood from FIGS. 4 and 5. FIG. 4 shows diagrammatically the positions from time to time of a knitting butt 39 and of the clearing means 28 and the camming-down means 29 of a knitting needle for a complete revolution of a cam disc, broken-line curves 77 and 78 showing the paths of the clearing portion and the camming-down portion, respectively, of the associated driving element which are followed during a revolution of the cam disc. The angle of rotation of the cam disc is plotted along the abscissa, while the extent of the shifting of the clearing means 28 and, consequently, of the knitting needle with respect to the run-through position which is obtained for any angle of rotation is plotted along the ordinate. FIG. 5, on the other hand, shows diagrammatically sections through a needle bed at the points indicated in FIG. 4 by Roman numerals, so that the relative position of the cam device at any given time becomes visible.

During the first part of the rotation of the cam disc, the knitting needles 5 are raised, since the clearing portions 25 of the driving elements 12 are directly coupled with the clearing means 28 and the play or clearance is arranged above the camming-down means 29. After the curve 77 has reached its highest point, the associated knitting needles remain in their highest position for a time by reason of this play, although the next camming-down throw of the driving element 12 has already begun. Only when the camming-down portion 24 of the driving element runs onto the camming-down means 29 (curve 78), is the associated knitting needle also lowered again, so that the play is now arranged below the clearing means 28.

When the knitting needle has reached the position indicated by the line I and the camming-down throw or stroke produced by the driving element 12 is therefore almost completed, the cam 48 of the cam device is located in the immediate vicinity of the knitting butt 39 and takes this over at the point indicated by the line II, which corresponds to the normal run-through position, so that from this point on the camming-down means 29 is no longer controlled for a time by the driving element 12, as is indicated by a line 81 denoting the normal path of the knitting butt 39. In the further course of the rotation of the cam disc, the knitting butt 39 and, consequently, also the knitting needle, is cammed down or lowered with the aid of the cam 48 below the normal run-through position by as much as is desired for forming a loop, the maximum camming-down depth which is adjustable being determined, as can be gathered from FIGS. 4 and 5, by the play between the clearing portion 25 and the clearing means 28, on the one hand, and between the camming-down portion 24 and the camming-down means 29, on the other hand.

After the knitting needle has been cammed down at the point III to the depth predetermined by the cam 48, the lower edge of the knitting butt 39 runs onto the cam 47 (point IV), whereby the forming of a loop is completed and the knitting needle 5 is carried back into the normal run-through position, so that the clearing means 28 can be taken over again immediately thereafter by the clearing portion 25 of the driving element 12 at the point V and a fresh loop-forming operation can be initiated. Those knitting needles which have only been cleared as far as the tucking height or have remained in the normal run-through position are controlled in corresponding manner.

Consequently, both a part of the clearing throw and a part of the camming-down throw of the cam disc have no effect on the movement of the knitting needle.

Any flinging out of the knitting needles beyond the position defined in FIG. 4 by the maximum of the curve 77 may be prevented by means of limiting bars which, if necessary, co-operate with another needle butt.

Figure 6:
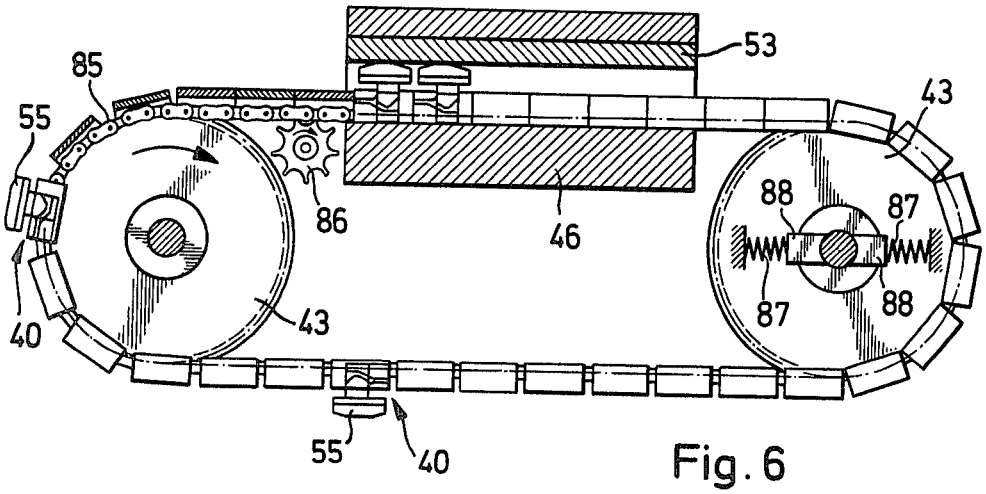
FIG. 6 shows a driving device for the cam device in accordance with the invention which can be seen in FIG. 2.

FIG. 6 shows details of the conveying device for the cam devices 40. A chain 85 is provided in place of the belt 42, the links of the chain being connected to one another with a play. Moreover, the guide pulleys 43, which are provided with suitable teeth, are in engagement with the chain 85. The guide pulley 43 on the right in FIG. 6 is slightly braked by means of brake shoes 88 biased by springs 87. The driving pulley 43 on the left in FIG. 6, on the other hand, is driven at knitting speed. The cam devices 40 are mounted on the chain 85 and these cam devices 40 have a length, measured in the direction of movement of the chain, which corresponds to the length of the knitting systems, so that by partially overcoming the play present between the chain links they abut against one another, i.e. they can be blocked together. The advantage obtained by means of this constructional form consists in that only that part of the chain 85 which runs in the direction opposite to the knitting direction is pulled, whereas that part of the chain 85 which runs in the knitting direction is pushed, so that while the cam devices are travelling past the knitting tools they are automatically given the correct intervals. Alternatively, the cam devices 40 may also be made shorter than the knitting systems, in which case the interval desired during knitting is produced by means of suitable distance pieces or the like.

Instead of one guide pulley 43, a pinion 86 (FIG. 6) may also be provided for driving the chain 85, the pinion being arranged in advance of the start of the fabric in the knitting direction and likewise causing the cam devices or distance pieces to butt against one another while they are travelling past the knitting tools. According to a particularly preferred constructional form, in addition to the pinion 86, the guide pulley 43 on the left in FIG. 6 is driven at knitting speed via initially tensioned resilient elements, the teeth of this guide pulley 43 engaging in such manner in the chain under initial tension of the resilient elements that, at rest, on removal of the chain 85, with relaxation of the resilient elements, the guide pulley 43 would turn further through a certain angle of rotation. In this way the result is obtained that the cam devices 40 or distance pieces are blocked together by the guide pulley 43 on the left in FIG. 6 and the pinion 86 alone provides the drive of the chain 85 and the cam devices 40.

Figure 7:
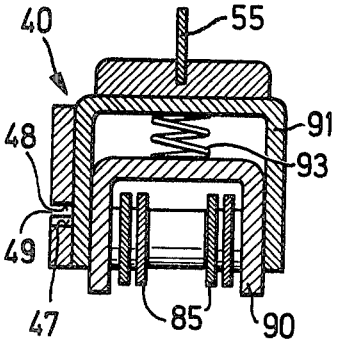
FIGS. 7 and 8 show a constructional form of the cam device according to the invention.
Figure 8:
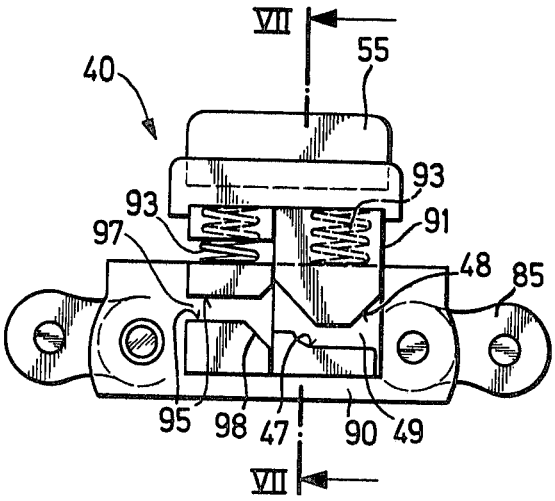

FIGS. 7 and 8 show an alternative constructional form of the cam devices 40 described with reference to FIGS. 1 to 3 and mounted on the belts 42. According to FIGS. 7 and 8, each cam device 40 includes an inner U-shaped member 90 connected to the chain and an outer U-shaped member 91 arranged slidably on the member 90, compression springs 93 being provided between the two U-shaped members and holding these two U-shaped members 90 and 91 at a certain distance from each other in the relaxed state.

Provided in an upper part of the outer U-shaped member 91 is at least one guide in which the plate 55 described with reference to FIGS. 1 to 3 can be inserted, this plate determining the distance between the two U-shaped members 90 and 91 when the cam devices 40 enter the passage between the slide rails 46 and 53.

As can be seen in particular from FIG. 8, the two cams 47 and 48 are mounted on the outer U-shaped member 91, the cam 48 producing the sinking, whereas in contrast to FIG. 2 the cam 47 produces only part of the clearing into the normal run-through position which is thereupon required. Adjacent the two cams 47 and 48, which form the track 49, there are two more cams 95 which form a trick 97 and are mounted on the inner U-shaped member 90, the lower cam 95 having an inclined surface 98 which terminates at the height of the normal run-through position and changes into a horizontal path at this point.

The advantage of the cam device 40 shown in FIGS. 7 and 8 compared with the cam device described with reference to FIG. 2 consists in that the track 49 can be adjusted to a value corresponding to the height of the knitting butt 39 of the knitting needle 5 and independent of the desired sinking depth, so that the knitting needle is guided positively during the sinking with any sinking depth that is adjusted. Irrespective of the position of the track 49 that is adjusted by means of the plate 55, the knitting butts 39 run into the track 97 after leaving the track 49 and are then raised into the normal constant run-through position by the inclined surface 98.

The invention is not limited to the embodiments which have been described. This applies in particular as regards the adjustability of the cam 48 by means of the plate 55 and the height-adjustable slide rails 53, which may be adjusted just once or be shifted in infinitely variable manner and according to pattern with the aid of suitable devices if the loop length must be varied during the continuous knitting process. Manually, mechanically, magnetically, optically, pneumatically, hydraulically and electrically controllable devices may be used for adjustment.

Basically, as many slide rails 53 are desirable for adjusting the cam devices 40 as there are knitting systems. Since, however, for technical reasons connected with knitting, independent adjustment of successive cams 48 is necessary only within the repeat width in the case of textured patterns and only within the colour sequence in the case of Jacquard patterns, the number of slide rails 53 needed may be greatly reduced.

If only adjustment when the machine is at a standstill is desirable, the cam devices may also be adjusted with the aid of simple screw spindles or shims, apart from slide rails. There are also suitable for adjusting the cam devices 40 when the knitting machine is running, apart from the slide rails 53, controllable switching devices arranged remote from the rows of needles and which preset or preadjust each cam device individually, or devices arranged remote from the rows of needles and operating with selectable shims. If a switching device is employed, the adjustable parts, for example, are clamped by powerful springs, the clamping connection being opened in the switching device by means of a cam, a fresh positioning being thereafter carried out with the aid of a second cam adjustable in height or an adjustable stop and the clamping connection being then re-established. If shims are employed, one or more shims are removed from a magazine, according to the desired camming-down depth, with the aid of a feed unit and offered to an adjusting device for the sinker element. As in the case of the switching device, a clamping connection is opened and a camming-down depth is thereafter adjusted or set in accordance with the thickness of the shims and the clamping connection is re-established. The shims removed from the adjusting device can be sorted and introduced into the magazine again.

In the case of a knitting machine having two needle beds, care must be taken that the knitting points associated with one another in the two needle beds are reached exactly one after the other, for which purpose it is necessary to adjust or set the cam devices 40 which are adjacent in each case on the two needle beds 3 very accurately. In order to achieve this, the endless belts 42 or other corresponding conveying elements, such as chains, wires, wire cables, etc., may be provided with perforations, cams or dogs or the like in or from which the cam devices 40 are suspended at the desired interval, so that they revolve continuously at knitting speed without the relative interval between adjacent or opposite cam devices 40 being able to change.

The cam devices 40 need not be fixedly connected to the endless conveying elements, but may be arranged relatively loosely on them and revolve with them. In this case, for exact positioning of the cam devices 40 during their action on the knitting butts, a second conveying device is provided, for example by providing conveyor worms along the needle beds 3, these conveyor worms taking over the cam devices at the beginning of the needle beds 3 and conveying them to the end of the needle bed 3.

The phase positions or relationships of the cam devices 40 and of the driving shafts 7 on two or more needle beds 3 can be produced and changed by employing a suitable coupling means, for example a gearing.

With return conveyance taking place at knitting speed, the number of cam devices 40 required per needle bed is more than twice as great as the number of systems present. Alternatively, the cam devices may also be conveyed back at a speed substantially greater than the knitting speed, in particular where two conveying devices are employed. In this case, substantially fewer cam devices 40 are needed, in dependence upon the speed of return conveyance.

If it is desirable to adjust a cam device 40 to different sinking depths without varying the position of the slide rail 53 associated also with other cam devices 40, a second plate 55 may be mounted on this cam device, this plate co-operating with another slide rail inserted at the desired moment. Such an arrangement is suitable in particular for producing knitted fabrics having draw threads.

Instead of the cam device 40 or in addition thereto, a cam operative in the opposite direction may be provided which, for example, effects a clearing of the knitting tools beyond the normal highest position. With such a cam, the transfer of loops from the knitting needles of one needle bed to the knitting needles of the other needle bed can be controlled. In this case likewise, the driving connection of the knitting tool with the cam disc has so much play that, in addition to the movement produced by the cam disc, the knitting tool is movable by a length which is smaller than the distance of movement produced by the cam disc.

What we claim is:

1. A knitting machine comprising: at least one needle bed; at least one knitting tool which is movably mounted in said needle bed; at least one eccentric cam disc rotatably mounted in said needle bed, driving means for coupling said knitting tool with said cam disc for reciprocating said knitting tool in at least two opposite directions during knitting operations, said driving means permitting some play such that said knitting tool may be reciprocated in at least one of said directions by an additional distance; and adjustable means cooperating with said knitting tool for superimposing an additional movement on the movements thereof caused by said cam disc in said at least one of said directions by a preselectable part of said additional distance.

2. A knitting machine comprising: at least one needle bed; at least one knitting tool which is movably mounted in said needle bed; at least one eccentric cam disc rotatably mounted in said needle bed, driving means for coupling said knitting tool with said cam disc for reciprocating said knitting tool in at least two opposite directions during knitting operations, said driving means permitting some play such that said knitting tool may be reciprocated in at least one of said directions by an additional distance; and an adjustable cam device movable transversely of said directions of movement of said knitting tool and cooperating with said knitting tool for superimposing an additional movement on the movements caused by said cam disc in said at least one of said directions by a preselectable part of said additional distance.

3. A knitting machine according to claim 2, wherein said adjustable cam device cooperates with the butt of said at least one knitting tool.

4. A knitting machine according to claim 2, and further comprising: a plurality of knitting tools mounted in said needle bed in parallel arrangement with said at least one knitting tool, each knitting tool having at least one butt; a driving shaft rotatably mounted in said needle bed; a plurality of eccentric cam discs mounted on said driving shaft together with said at least one cam disc in an angular staggered and parallel relationship, driving means for coupling said knitting tools with said cam discs, said adjustable cam device having a first cam rising in said one of said directions and successively cooperating with the butts of said knitting tools when moved past said knitting tools in said needle bed, said first cam beginning at a height which corresponds to the position of the butts of said knitting tools shortly before the termination of the movement produced by said cam discs in said one of said directions; and a conveying device for moving said cam device past said knitting tools, wherein the speed of said conveying device and the rotational speed of said driving shaft are synchronized so that the speed of said cam device is adapted to the phase relationships of said knitting tools which depend on the angular staggering of said cam discs.

5. A knitting machine comprising at least one needle bed; a plurality of knitting tools mounted in said needle bed in parallel arrangement, each knitting tool having at least one butt; a driving shaft rotatably mounted in said needle bed; a plurality of eccentric cam discs mounted on said driving shaft in an angular staggered and parallel relationship, driving means for coupling said knitting tools with said cam discs for reciprocating said knitting tools in at least two opposite directions during knitting operations, said driving means permitting some play such that said knitting tools may be reciprocated in at least one of said directions by additional distances; at least one adjustable cam device movable transversely of said directions of movement of said knitting tools and successively cooperating with the butts of said knitting tools when moved past said knitting tools in said needle bed for super-imposing additional movements on the movements caused by said cam discs in said at least one of said directions by preselectable parts of said additional distances, and a conveying device for moving said adjustable cam device past said needle bed, wherein the speed of said conveying device and the rotational speed of said driving shaft are synchronized so that the speed of said adjustable cam device is adapted to the phase relationships of said knitting tools which depend on the angular staggering of said cam discs.

6. A knitting machine according to claim 5, wherein each of said driving means for coupling said knitting tools with said cam discs comprises a driving element and a coupling element connected to one of said knitting tools and means for controlling said coupling elements according to a pattern.

7. A knitting machine according to claim 5, wherein said first adjustable cam device begins at a height which corresponds to the positions of the butts of said knitting tools shortly before the termination of the movement produced by said cam discs in said one of said directions.

8. A knitting machine according to claim 5, wherein said driving means comprises driving elements for driving connection of said knitting tools with said cam discs, said driving elements being coupled to said cam discs and said driving elements having a raising portion cooperating in one of said two directions with a raising means of said knitting tools and a drawing-down portion cooperating in the opposite of said two directions with a drawing-down means of said knitting tools, the distances between said raising portions and said drawing-down portions being greater than the distances between said raising means and said drawing-down means.

9. A knitting machine according to claim 4, wherein said cam device has a second cam acting on said butts in the opposite of said directions and having a rising part which rises in said opposite direction and which begins behind the end of said first cam as viewed in the direction of movement of the cam device.

10. A knitting machine according to claim 4, and having a number of systems and comprising a number of cam devices corresponding to the number of systems, the cam devices being spaced apart a distance corresponding to the distance between said systems, said systems being defined by the angular staggering of said cam discs.

11. A knitting machine according to claim 10, and further comprising at least one additional cam device and means for conveying each cam device arriving at the end of said needle bed back to the beginning of said needle bed without acting on the butts of the knitting tools.

12. A knitting machine according to claim 10, wherein said conveying device includes an endless conveying element and two guide pulleys revolving at knitting speed for supporting said conveying element, that part of the conveying element running in the knitting direction arranging the cam devices in the region of the butts, and wherein at least twice the number of cam devices, compared with the number of systems, are mounted on said conveying element.

13. A knitting machine according to claim 12, and further comprising a fixed slide rail extending over said needle bed, said cam devices sliding on said rail during their movement in the knitting direction and said rail being arranged in a defined position with respect to the knitting tools.

14. A knitting machine according to claim 4, and further comprising a spring exerting a force against said first cam and wherein said first cam is mounted on said cam device to slide in opposition to the force of said spring.

15. A knitting machine according to claim 9, and further comprising a common member mounted on said cam device to slide thereon and a spring, wherein said first and second cams are fixed on said common member to slide on said cam device in opposition to the force of said spring.

16. A knitting machine according to claim 14, and further comprising at least one adjustable slide rail extending over the needle bed on which said first cam slides during the movement of the cam device past said knitting tools and for adjusting the extent of the additional movement of said knitting tools.

17. A knitting machine according to claim 16, and further comprising a plurality of parallel and separately adjustable slide rails and attachable plate means for applying each first cam against at least one preselected slide rail.

18. A knitting machine according to claim 16, and further comprising a separate slide rail associated with each first cam.

19. A knitting machine according to claim 13, wherein said cam device has two additional cams behind said first and second cams in the knitting direction, said additional cams being fixed to that part of said cam device which slides on the fixed slide rail and forming a track in which said butts slide after leaving said first cam and said second cam, the outlet of said track ending at the height of the normal run-through position of said butts.

20. A knitting machine according to claim 10, wherein said conveying device comprises an endless chain and at least two toothed guide pulleys for supporting said endless chain and revolving at knitting speed, the links of said chain being connected to one another with play, one guide pulley being arranged in advance of the start of the needle bed in the knitting direction and being driven at knitting speed and the other guide pulley being arranged after the end of the needle bed in the knitting direction and effecting a braking action.

21. A knitting machine according to claim 10, wherein said conveying device comprises an endless chain and at least two toothed guide pulleys for supporting said endless chain and revolving at knitting speed, the links of said chain being connected to one another with play, one guide pulley being arranged after the end of the needle bed in the knitting direction and effecting a braking action, and a pinion arranged in advance of the start of the needle bed in the knitting direction, for engagement with the chain and for driving said chain at knitting speed.

22. A knitting machine according to claim 21, wherein the other guide pulley is arranged in advance of said pinion in the knitting direction and is driven at knitting speed and resilient means for driving said other guide pulley, said other guide pulley engaging said chain under initial tension of said resilient elements.

23. A knitting machine according to claim 5, wherein said cam device for superimposing the additional movement comprises a switching device for adjusting the adjustable cam device for selecting a preselectable part of said additional distance.

24. A knitting machine according to claim 2, and further comprising a driving element for driving connection with said knitting tool and said cam disc, said driving element being connected to said cam disc for drive in two opposite directions, and said driving element having a raising portion cooperating in one of said two directions with a raising means of the knitting tool and a drawing-down portion cooperating in the opposite of said two directions with a drawing-down means of the knitting tool, the distance between the raising portion and the drawing-down portion being greater than the distance between the raising means and the drawing-down means.

25. A knitting machine according to claim 2, wherein said driving means for coupling said knitting tool with said cam disc comprises a driving element and a coupling element connected to said knitting tool and means for controlling said coupling element according to a pattern.

* * * * *